US006050808A

United States Patent [19]

Schloss

[11] Patent Number: 6,050,808

[45] Date of Patent: Apr. 18, 2000

[54] CONTROL DEVICE FOR GAS BURNERS

[75] Inventor: Edgar Vom Schloss, Rosstal, Germany

[73] Assignee: Diehl Stiftung & Co., Nürnberg, Germany

[21] Appl. No.: 09/088,599

[22] Filed: Jun. 1, 1998

[30] Foreign Application Priority Data

Jun. 19, 1997 [DE] Germany ..... 197 25 921

[51] Int. Cl.[7] ..... F23N 5/00; F24C 3/00; F16K 31/02

[52] U.S. Cl. ..... 431/86; 431/85; 431/83; 126/39 E; 251/129.01; 251/129.15

[58] Field of Search ..... 431/86, 85, 83; 126/39 E; 251/129.01, 129.15

[56] References Cited

U.S. PATENT DOCUMENTS

| | | | |
|---|---|---|---|
| 1,945,109 | 1/1934 | Fonseca | 431/55 |
| 2,302,624 | 11/1942 | Gallagher | 431/45 |
| 2,303,672 | 12/1942 | Wantz | 431/45 |
| 2,353,042 | 7/1944 | Koch | 431/45 |
| 2,363,073 | 11/1944 | Mantz | 431/46 |
| 2,562,536 | 7/1951 | Mayer | 431/45 |
| 2,610,682 | 9/1952 | Weber | 431/45 |
| 2,711,216 | 6/1955 | Arden | 137/66 |
| 2,735,484 | 2/1956 | Hoff | 431/45 |

FOREIGN PATENT DOCUMENTS

| | | | |
|---|---|---|---|
| 0 686 811 A2 | 12/1995 | European Pat. Off. . | |
| 34 21 039 C2 | 4/1986 | Germany | F23Q 13/00 |
| 41 33 660 A1 | 4/1993 | Germany | F23N 1/00 |
| 1038141 | 8/1966 | United Kingdom . | |
| 2 196 150 | 4/1988 | United Kingdom . | |

*Primary Examiner*—Ira S. Lazarus
*Assistant Examiner*—David Lee
*Attorney, Agent, or Firm*—Scully, Scott, Murphy & Presser

[57] ABSTRACT

There is provided a control device for a gas burner used for gas cookers, in which the gas burner is connected to a flame monitoring device. The flame monitoring device has a timing device (11) which regulates a closing mechanism of a gas valve (7) or a gas control unit (2) in accordance with a predetermined switch-on time and/or a predetermined switch-off time. In that arrangement the control device (11) can act directly on the gas valve (7). It can however also act on an electromechanical relay (20) or an electro-hydraulic relay (21) which are each connected to a respective bimetal control device of the flame monitoring device.

5 Claims, 3 Drawing Sheets

CONTROL DEVICE FOR GAS BURNERS

BACKGROUND OF THE INVENTION

1. Field of the Invention

The invention concerns a control device for a gas burner, having a gas valve for the feed of gas to the gas burner and a flame monitoring device which is operatively connected to the gas valve.

In practice gas-operated cookers with mechanical gas regulating devices usually employ gas control units for controlling the through-flow of gas to the flame discharge opening of the gas burner. In order to be able to measure ignition of the gas, bimetal sensors are disposed beside the gas discharge openings in such an arrangement. The user is now required to hold or depress an actuating element until the bimetal sensor has reached a predetermined temperature. Thereafter, the gas flame continues to burn even without the actuating element being depressed. If for any reasons the gas flame goes out, the sensor of the bimetal device cools down and by way of a mechanism closes the feed of gas in the gas control unit. That prevents a discharge flow of unburnt gas.

2. Discussion of the Prior Art

DE 34 21 039 C2 discloses a control device for a gas burner having an igniter for igniting gas and a gas valve which influences the feed of gas to a burner. A flame monitoring unit serves to keep the gas valve open as long as the gas is burning. In order to permit the gas to be re-ignited, a controllable switch has been fitted, which is controlled by the flame monitoring unit and which closes while the gas is burning. The controllable switch remains closed for a given time after extinction of the flame.

SUMMARY OF THE INVENTION

Taking the above-indicated state of the art as its basic starting point, the object of the present invention is to provide a control device for gas burners, which affords a system enlargement for the gas cooker and in that respect keeps the safety aspect of the system at an unchangedly high level.

In accordance with the invention that object is attained by the provision of a flame monitoring device having a timing device which regulates the closing mechanism of the gas valve or a gas control unit in accordance with a predetermined switch-on time and/or switch-off time.

The system enlargement that the invention aims to achieve essentially provides that the gas flame issuing at the gas burner can be controlled in a timed manner. That timed control is effected in principle by a cooker timeswitch, in which respect here a radio-controlled cooker timeswitch can be used, in a particularly advantageous construction. In order now to control the gas flame in timed manner, various possible design configurations can be incorporated into the system enlargement. Thus it is possible to fit upstream of a control unit a gas valve which closes the feed of gas when a set time expires. As a result of that arrangement the flame at the discharge opening of the gas burner is extinguished.

On the other hand it is possible to use a bimetal control arrangement which is used indirectly as a closing mechanism. Thus the bimetal control arrangement may influence an electro-mechanical relay or an electro-hydraulic relay which introduces a contact pushrod or a contact piston into the line or between the time-controlled expansion element of a temperature sensor. In this case outward movement of the contact pushrod or the contact piston is now implemented by way of the time control arrangement. In that way finally the line of the temperature sensor is relieved of load again and thereby the closing mechanism of the gas feed is actuated so that the temperature sensor simulates an inadequate temperature and the gas control unit finally closes the gas feed.

A further possible way of timed control of the gas flame provides displacing a baffle plate or screen between the gas flame and the temperature sensor. As a result of that arrangement the temperature sensor cools down and closes the gas feed by way of the gas control unit.

BRIEF DESCRIPTION OF THE DRAWINGS

An embodiment of the invention is illustrated in the drawing in which.

DETAILED DESCRIPTION OF PREFERRED EMBODIMENTS

Figure 1:
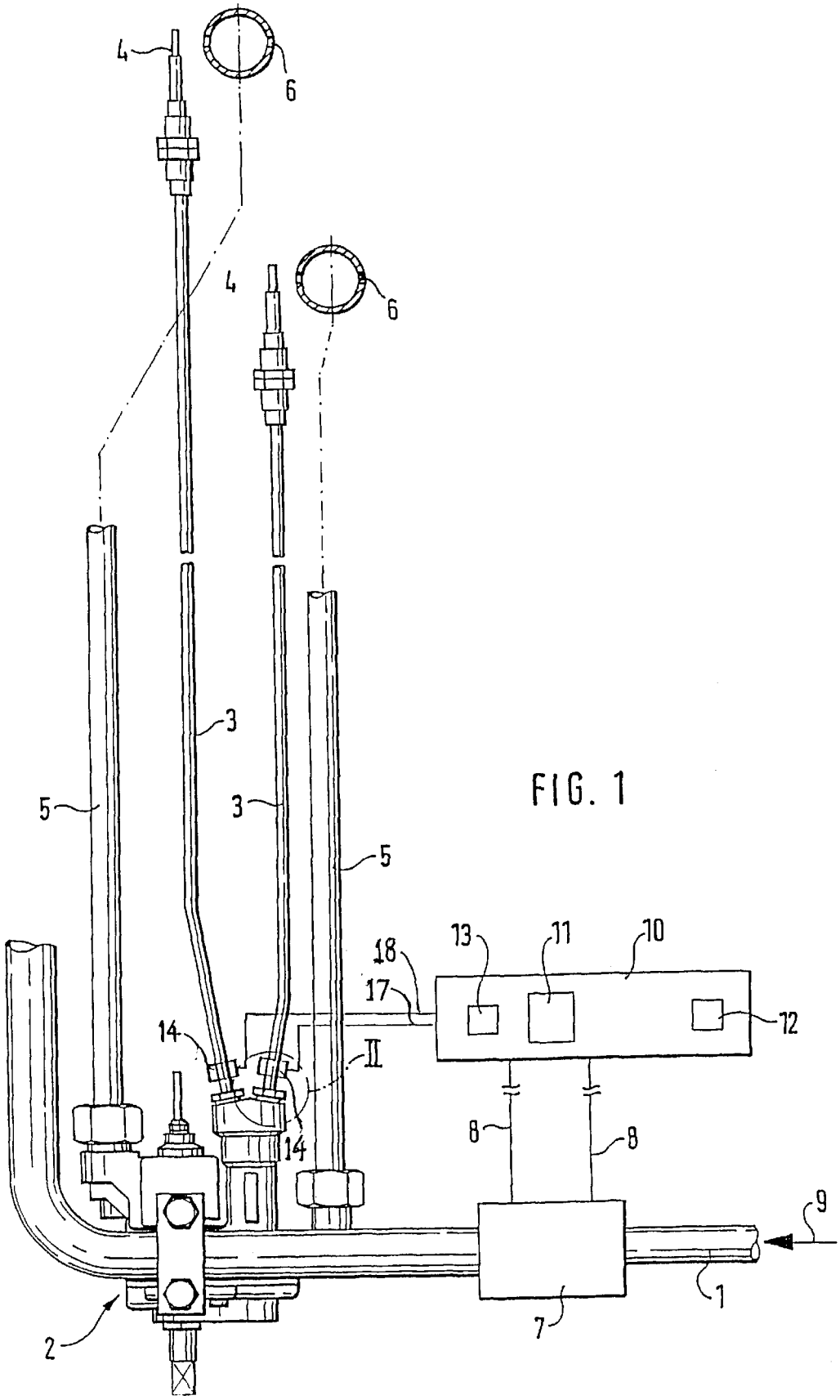
FIG. 1 is a diagrammatic simplified view of gas feed lines and temperature sensor.

FIG. 1 shows a main gas feed line 1 into which is fitted a gas control unit 2. In the illustrated example, lines 3 go from the gas control unit 2 to temperature sensors. Two gas lines 5 also branch off the main gas feed line 1, the flame discharge openings 6 of the gas lines 5 terminating in the proximity of the temperature sensors 4. Disposed upstream of the gas control unit 2 and also upstream of the first branching point of a gas line 5 in the main gas feed line 1 is a gas valve 7 with control lines 8 for connection to a time-control or timing device 11. The gas flow direction is indicated by the arrow 9.

The mode of operation of this gas control device is now such that the gas control unit 2 controls the through-flow of gas. For measuring ignition of the gas, mounted beside the flame discharge openings 6 of the gas lines 5 are the temperature sensors 4 which are usually in the form of sensors which incorporate thermally-responsive differentially expandable bimetallic elements indicative of temperature changes. The user must now hold an actuating device or depress a toggle or another mechanical element, until there is a predetermined temperature at the bimetal sensor. Thereafter the user can release the actuating member because now, with the flame burning, the gas feed automatically remains turned on, by way of the gas control units. If in contrast the flame goes out, the temperature sensor cools down and the gas feed is closed by way of an incorporated closing mechanism. That then prevents the discharge flow of unburnt gas.

The gas valve 7 which is fitted onto the main gas feed line 1, with the control lines 8, is connected to a timing arrangement 10. Disposed in the timing arrangement 10 is a clock, for example a radio-controlled or a quartz-controlled cooker timeswitch 11. The assembly also has input keys or buttons 12 for the input of a starting time and 13 for the input of a finishing time. In that way the user can determine the moment in time at which the gas valve is opened and ignition of the gas occurs at a given cooking location or gas discharge nozzle. For that purpose, the input of the finishing time establishes at the same time the moment in time at which the gas valve 7 closes and thus shuts off the feed of gas. After the gas feed is interrupted, the flame will be extinguished.

When a starting time is inputted into the timing arrangement 10 it is naturally necessary to ensure that automatic ignition of the gas occurs at the point of consumption. For that purpose, before opening of the gas feed, an ignition device, for example a spark ignition arrangement or an incandescent igniter, would have to be switched on. In that case however it must be possible to detect ignition after 10 seconds by a measuring procedure. After the expiry of that period of time the system automatically cuts off again and the gas feed is closed.

In principle the timing effect, namely the starting time and the finishing time, can be controlled by interruption of the electronic flame detection system. For example for the starting time an electronic detection system will close and switch on the main voltage (reset procedure); when the finishing time is reached the electronic detection system will interrupt the gas feed.

Figure 1A:
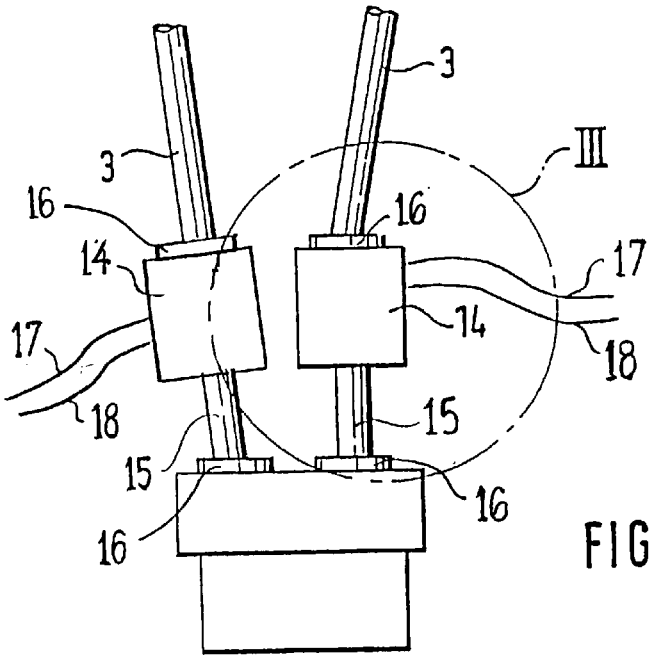
FIG. 1A is a view on an enlarged scale of the detail indicated at II in FIG. 1.
Figure 1B:
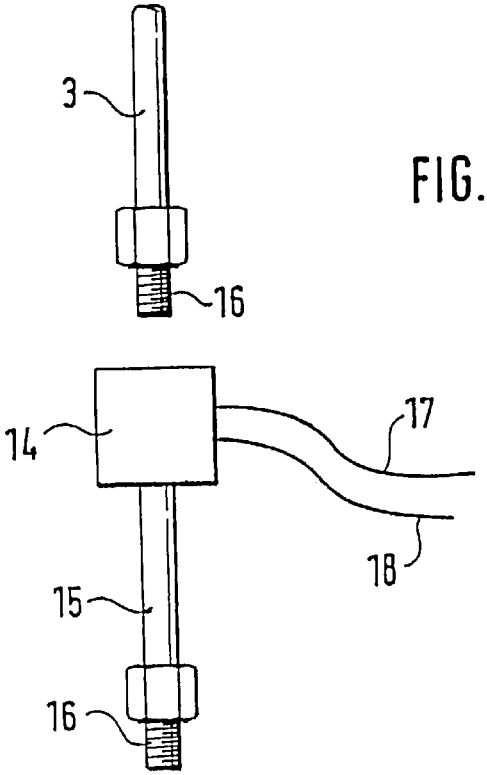
FIG. 1B is a view on an enlarged scale of the detail indicated at III in FIG. 1A.

As FIGS. 1A and 1B diagrammatically show, a sensor device, which may be in the form of thermally-responsive bimetallic elements, and which may be employed to acuate a relay device 14 which is acted upon by the timing device 11 can be fitted into the line 3 of a temperature sensor 4. For that purpose the housing of the relay device 14 is connected with a pipe portion 15 to the control unit 2. The connection can be made by way of a screwthreaded or bayonet connection 16. Disposed on the opposite side of the housing to the pipe portion 15 is the line 3 which is also sealingly connected to the housing 14 by a screwthreaded or bayonet connection 16. Leading into the housing 14 are two electric lines 17 for the positive terminal and 18 for the 30 negative terminal of a coil 19, which is fitted into the housing 14, of a relay indicated at 20 and 21 respectively. The electrical connection to the timing arrangement 10 is made by way of those control lines 17 and 18.

Figure 2:
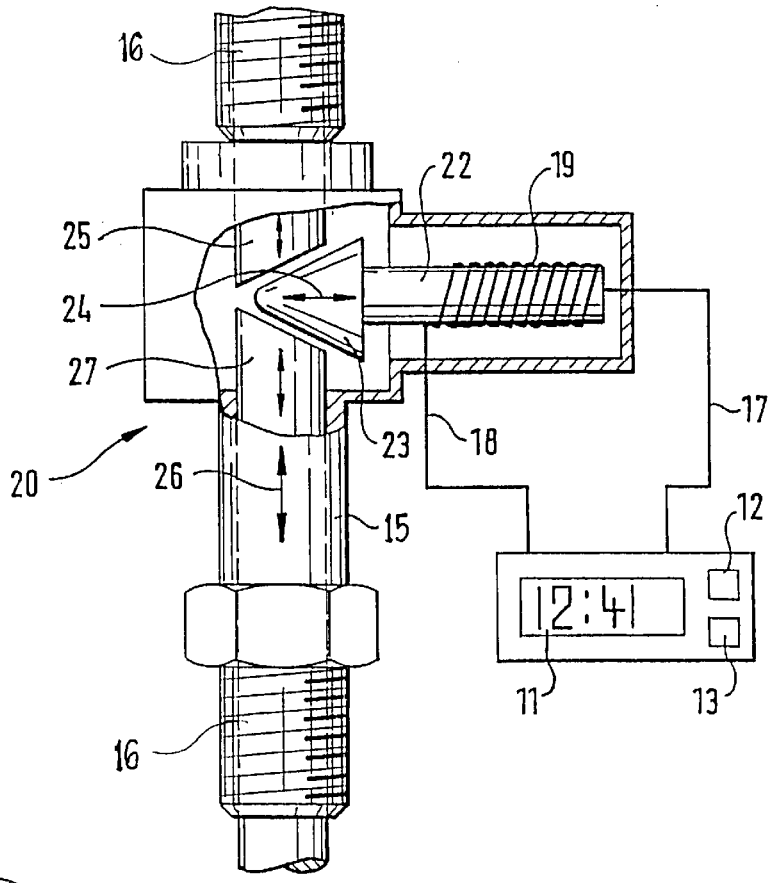
FIG. 2 is a view in cross-section of a control device in the line of a temperature sensor.

The bimetal control device 14 as shown in FIG. 2 is in the form of an electromechanical relay. A bar 22 is surrounded by a coil 19. At its one end the bar 22 has a contact pushrod 23 which is axially movable as indicated by the double-headed arrow 24. As a result the contact pushrod 23 can be inserted into the line 3 of the temperature sensor 4.

When the gas is ignited and when the pushrod 23 of the temperature sensor 4 is mechanically depressed, the bar 25 is displaced downwardly in the direction of the arrow 26 by virtue of the temperature detected by the bimetal sensor. That slight lengthwise expansion is sufficient to urge the contact pushrod 23 downwardly against the second linearly movable bar 27 which is arranged coaxially with respect to the bar 25. By virtue thereof, the line of the gas feed is opened and held open by the control unit 2. When a finishing time is inputted by means of the input keys or buttons 12, 13, the timing device 11 (cooker timeswitch) switches the relay by way of the coil 19, in such a way that the contact pushrod 23 is withdrawn somewhat from the connection between the bars 25 and 27. As a result of this, the lower bar 27 is moved upwardly again in the opposite direction to the arrow 26, whereby the control unit 2 closes the gas feed line. This arrangement therefore simulates cooling of the bimetal sensor, as is normally the case only when the gas flame has gone out. That simulation permits timed control and finishing shut-down of the gas feed.

The electro-hydraulic relay 21 is of substantially the same design configuration as the electro-mechanical relay 20. The electro-hydraulic system has a piston 28 which can be moved into the mutually oppositely disposed liquid lines 29 and 30. The piston shank 31 is again surrounded by a coil 19 wrapped therearound. A pressure applied to the tip of the temperature sensor 4 is transmitted by way of the columns of liquid in the lines 29 and 30 which is extended in the housing 14. That pressure causes a gas feed line to be opened in the control unit 2. If the gas feed is to be closed, the piston 28 is withdrawn in a timed manner and in accordance with the period of time that has expired, by way of the coil 19, whereby the pressure in the direction indicated by the arrow 32 is slightly relieved. That pressure relief effect is again sufficient to close the valve in the control unit 2 for the gas feed. In this case also therefore a negative lengthwise expansion of the temperature sensor 4 is manipulated.

In the structure shown in FIG. 2 the inwardly moved position of the contact pushrod 23 along arrow 24 signifies functioning of the bimetal sensor as without a relay. In other words,when the bimetal temperature is reached, the action of the user on the system is removed and the gas feed is maintained. The timing arrangement then provides for pulling out the contact pushrod 23 or hammer member, whereby an inadequate temperature is simulated for the temperature sensor 4. Thereupon the gas control unit 2 closes the gas feed.

Figure 3:
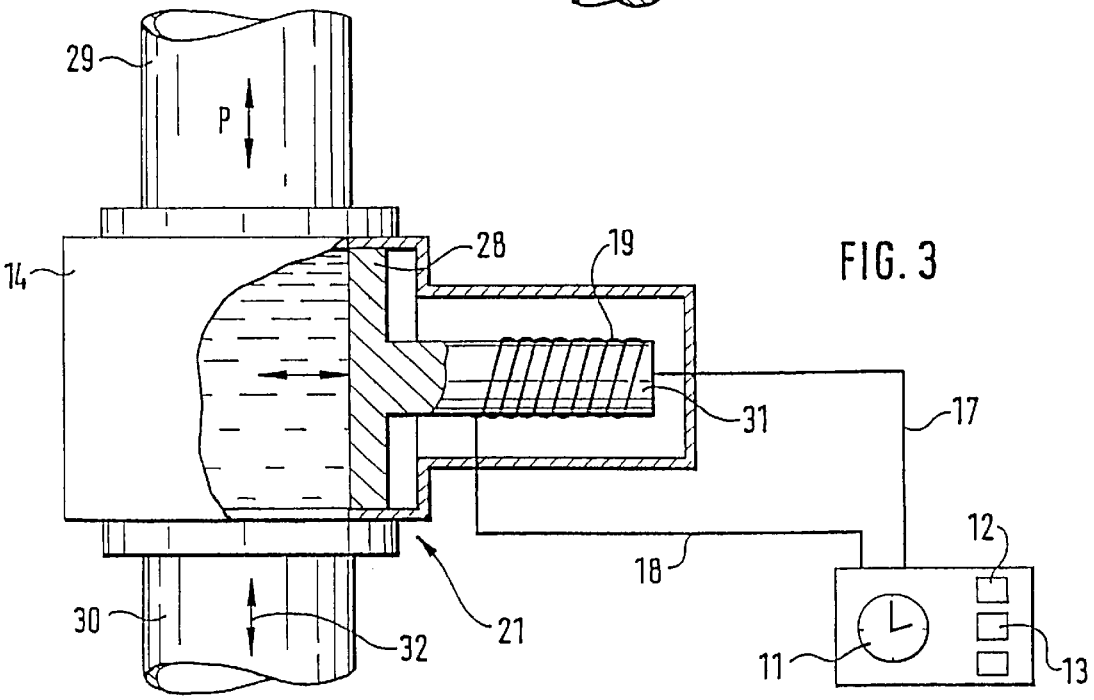
FIG. 3 is a view in section of a control device of another kind in the line of a temperature sensor.

That function is repeated in FIG. 3 where, instead of the bars 25 and 27, the bimetal member is here connected to a capillary tube which uses a liquid for transmission of the expansion of the bimetal member.

I claim:

1. A control device for at least one gas burner, of a gas cooker, having a thermostatic flame monitoring device which is operatively connected to the control device; a line for the gas feed being located upstream of a gas control unit for the at least one said gas burner; a timing device comprising a clock which is operatively connected with a bimetallic sensor arrangement for the flame monitoring device for each respective flame outlet opening and is selectively equipped with a sensor located at or proximate the flame outlet opening of said at least one gas burner and includes an expansion element into which there engages a relay of said timing device;

said relay including an electro-mechanical relay actuated by said timing device, and said relay further including a contact pusher which is movable into a path of movement of said expansion element, said contact pusher having a shank in operative connection with said timing device for selecting effectuating the activation and termination of said gas feed, and said contact pusher is formed substantially wedge-shaped or conical and includes a peripheral surface in operative connection with correspondingly shaped end surfaces of said expansion element rod member.

2. A control device as claimed in claim 1, wherein said relay comprises a contact piston which is movable into a path of movement of said expansion element, said piston having a piston rod which is operatively connected with said timing device for effectuating the termination of said gas feed.

3. A control device as claimed in claim 1, wherein said expansion element comprises a rod member having an upper portion and a lower portion, said shank of the contact pusher being introduceable between oppositely located axial end surfaces of the upper and lower portions of said rod member.

4. A control device as claimed in claim 1, wherein said clock comprises a cooking timer for actuating said control device.

5. A control device as claimed in claim 1, wherein said clock comprises a radio-controlled cooking timer.

* * * * *